US010415333B2

(12) United States Patent
Heitmann

(10) Patent No.: US 10,415,333 B2
(45) Date of Patent: Sep. 17, 2019

(54) REVERSING DIFFERENTIAL PRESSURE STICKING

(71) Applicant: Schlumberger Technology Corporation, Sugar Land, TX (US)

(72) Inventor: Norbert Heitmann, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 190 days.

(21) Appl. No.: 15/584,468

(22) Filed: May 2, 2017

(65) Prior Publication Data

US 2018/0320464 A1 Nov. 8, 2018

(51) Int. Cl.

| | |
|---|---|
| ***E21B 21/08*** | (2006.01) |
| ***E21B 21/10*** | (2006.01) |
| ***E21B 31/03*** | (2006.01) |
| ***E21B 47/06*** | (2012.01) |
| ***E21B 44/00*** | (2006.01) |
| ***E21B 34/10*** | (2006.01) |

(52) U.S. Cl.

CPC ..... *E21B 21/08* (2013.01); *E21B 21/10* (2013.01); *E21B 31/03* (2013.01); *E21B 34/10* (2013.01); *E21B 44/00* (2013.01); *E21B 47/06* (2013.01)

(58) Field of Classification Search

CPC .... E21B 31/00; E21B 31/03; E21B 2021/005; E21B 21/00; E21B 21/08; E21B 21/10; E21B 47/06

See application file for complete search history.

(56) References Cited

U.S. PATENT DOCUMENTS

| | | | | |
|---|---|---|---|---|
| 3,104,707 | A * | 9/1963 | Overly | E21B 31/03 166/155 |
| 3,213,941 | A * | 10/1965 | Nelson | E21B 31/03 166/178 |
| 3,236,307 | A * | 2/1966 | Brown | E21B 31/03 166/150 |
| 3,246,696 | A * | 4/1966 | Fox, Jr. | E21B 31/03 166/301 |
| 4,025,235 | A * | 5/1977 | Newbrough | E21B 43/12 417/172 |
| 7,325,614 | B2 * | 2/2008 | Elder | E21B 31/03 166/301 |
| 2002/0112888 | A1 * | 8/2002 | Leuchtenberg | E21B 21/08 175/48 |
| 2011/0290562 | A1 * | 12/2011 | Standifird | E21B 21/08 175/57 |
| 2014/0326505 | A1 * | 11/2014 | Davis | E21B 47/0002 175/24 |
| 2016/0313166 | A1 * | 10/2016 | McCoy | B65G 5/00 |
| 2018/0320464 | A1 * | 11/2018 | Heitmann | E21B 21/08 |

FOREIGN PATENT DOCUMENTS

| | | | | |
|---|---|---|---|---|
| GB | 2090891 | A * | 7/1982 | E21B 7/04 |

* cited by examiner

*Primary Examiner* — Jennifer H Gay

(74) *Attorney, Agent, or Firm* — Rachel E. Greene

(57) ABSTRACT

Apparatus and methods for reducing differential pressure sticking of a drill string stuck against a sidewall of a wellbore by decreasing hydrostatic pressure around the drill string within the wellbore. Drilling fluid is displaced out of the wellbore by injecting a displacement fluid into an annulus defined between the sidewall and an exterior of the drill string, and pressure of the injected displacement fluid within the annulus is decreased by bleeding the injected displacement fluid out of the annulus.

4 Claims, 5 Drawing Sheets

REVERSING DIFFERENTIAL PRESSURE STICKING

BACKGROUND OF THE DISCLOSURE

Wells are generally drilled into the ground or ocean bed to recover natural deposits of oil and gas, as well as other desirable materials that are trapped in subterranean formations. Such wells are drilled into a formation using a drill bit attached to the lower end of a drill string. Drilling fluid is pumped from the wellsite surface down through the drill string to the drill bit. The drilling fluid lubricates and cools the bit, and may additionally carry drill cuttings from the wellbore back to the well site surface.

Differential pressure sticking can cause excessive friction between portions of the drill string and a sidewall of the wellbore, which can immobilize the drill sting within the wellbore. Differential pressure sticking is caused by the difference between the pressure of the formation and the hydrostatic pressure within the wellbore. Formations that are more permeable can present higher risks of differential sticking, because the higher permeability can increase "filter cake" deposition on the sidewall of the wellbore. That is, the differential between the higher wellbore pressure and the lower formation pressure urges drilling fluid into the formation, and a higher permeability of the formation permits more of the liquid portion of the drilling fluid to invade the formation, which results in more of the solids portion of the drilling fluid to build up on the sidewall of the wellbore. As the filter cake thickness increases, the risk of differential pressure sticking also increases, because thicker filter cake exposes more of the drill string circumference to the lower formation pressure, thus increasing the net force of the hydrostatic pressure urging the drill string into the sidewall of the wellbore.

The increasing net force of the hydrostatic pressure urging the drill string into the sidewall of the wellbore also increases friction between the drill string and the sidewall of the wellbore. When the friction exceeds the maximum pulling power of the rig, the drill string cannot be pulled free, such that the bottom hole assembly (BHA) at the bottom of the drill string is deemed "lost-in-hole" (LIH). Differential pressure sticking accounts for large monetary losses to the oil and gas industry, whether in the form of LIH BHAs, stuck pipe/BHA recovery efforts, or other consequential equipment recovery and/or wellbore reconstruction actions, including lost well sections to be re-drilled.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus including a fluid source operable for injecting a displacement fluid into an annulus defined between a sidewall of a wellbore and an exterior of a drill string differentially stuck in the wellbore, thereby displacing drilling fluid in the wellbore through an internal passage of the drill string to a wellsite surface from which the wellbore extends. The apparatus also includes a fluid measuring device operable for measuring volume of the drilling fluid displaced through the internal passage, and a bleed valve operable for bleeding the injected displacement fluid out of the annulus, thereby decreasing pressure of the injected displacement fluid within the annulus.

The present disclosure also introduces a method including displacing drilling fluid out of a wellbore by injecting a displacement fluid into an annulus defined between a sidewall of the wellbore and an exterior of a drill string stuck in the wellbore. Pressure of the injected displacement fluid within the annulus is reduced by bleeding the injected displacement fluid out of the annulus, and then the drill string is moved axially within the wellbore by applying tension to the drill string.

The present disclosure also introduces a method including reducing differential pressure sticking of a drill string stuck against a sidewall of a wellbore by decreasing hydrostatic pressure around the drill string within the wellbore by: displacing drilling fluid out of the wellbore by injecting a displacement fluid into an annulus defined between the sidewall and an exterior of the drill string; and decreasing pressure of the injected displacement fluid within the annulus by bleeding the injected displacement fluid out of the annulus.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
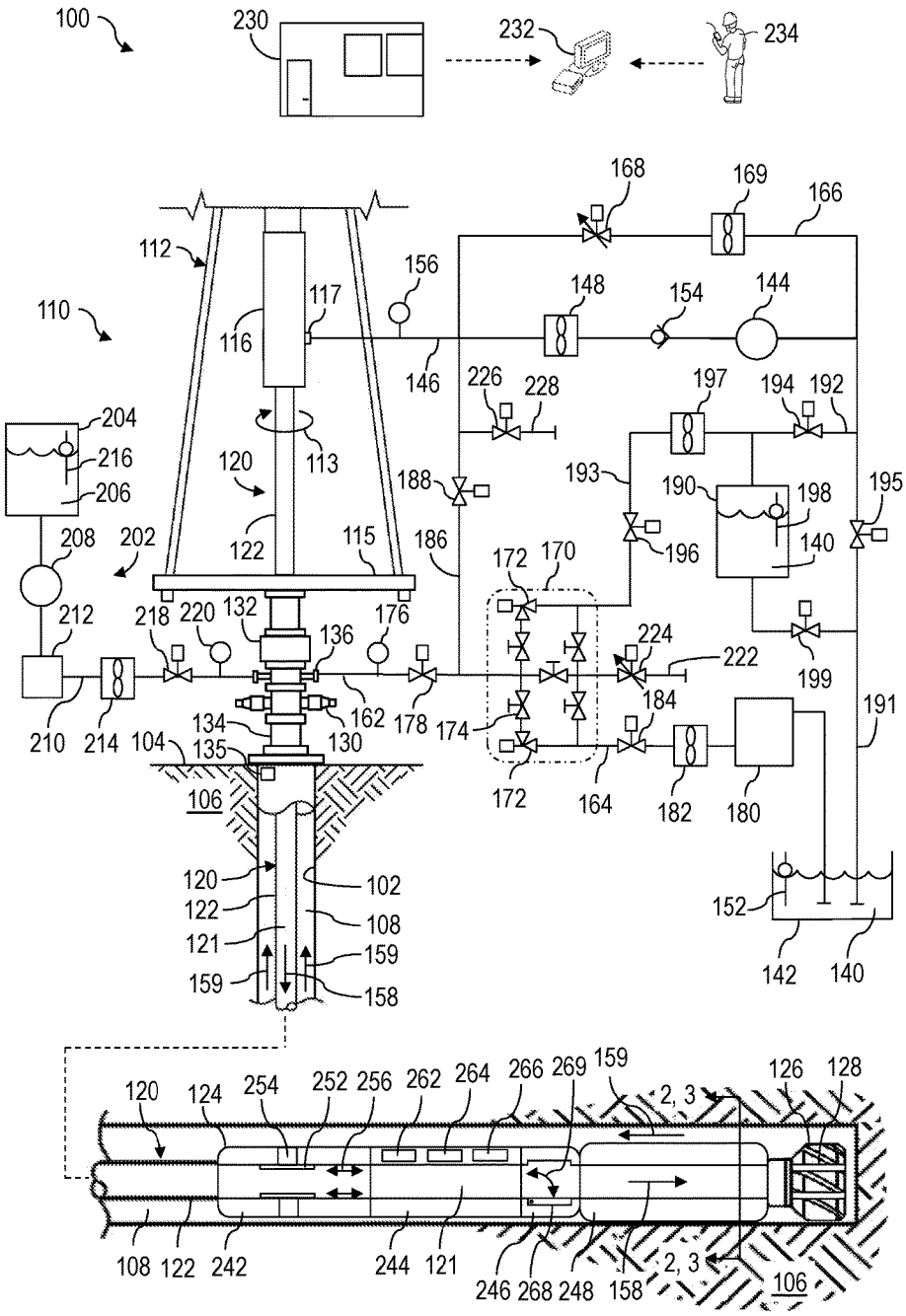
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of at least a portion of an example implementation of a wellsite system 100 according to one or more aspects of the present disclosure. The wellsite system 100 represents an example environment in which one or more aspects described below may be implemented. It is also noted that although the wellsite system 100 is depicted as an onshore implementation, it is understood that the aspects described below are also generally applicable to offshore and inshore implementations.

The wellsite system 100 is depicted in relation to a wellbore 102 formed by rotary and/or directional drilling from a wellsite surface 104 and extending into a subterranean formation 106. The wellsite system 100 includes surface equipment 110 located at the wellsite surface 104, including a platform, rig, derrick, and/or other wellsite structure 112 positioned over the wellbore 102. A drill string 120 suspended within the wellbore 102 from the wellsite structure 112 comprises a BHA 124 and means 122 for conveying the BHA 124 within the wellbore 102. The conveyance means 122 may comprise downhole tools, drill pipe, heavy-weight drill pipe (HWDP), cross-overs and subs such as stabilizers and reamers, wired drill pipe (WDP), tough logging condition (TLC) pipe, wireline, coiled tubing, and/or other means of conveying the BHA 124 within the wellbore 102.

The downhole end of the BHA 124 may include or be coupled to a drill bit 126. Rotation of the drill bit 126 and the weight of the drill string 120 operate to advance the BHA 124 into the formation 106 to form the wellbore 102. The drill bit 126 may be rotated from the wellsite surface 104 and/or via a downhole mud motor (not shown) connected with the drill bit 126. To facilitate rotation of the drill bit 126 from the wellsite surface 104, the wellsite structure 112 may comprise a top drive 116 connected to the uphole end of the conveyance means 122 in a manner permitting rotary motion 113 to be imparted to the drill string 120. The top drive 116 (and, thus, the drill string 120) may be suspended from the wellsite structure 112 via a travelling block and a drawworks (neither shown) or another tensioning device operable to selectively move the top drive 116 and the drill string 120 in uphole and downhole directions during drilling operations. However, a kelly and rotary table may be utilized instead of or in addition to the top drive 116.

The drill string 120 may be conveyed into the wellbore 102 through a plurality of well control devices disposed at the wellsite surface 104 on top of the wellbore 102 below the rig floor 115, perhaps in a wellhead cellar structure. The well control devices may include a blowout preventer (BOP) stack 130 and an annular fluid control device 132, such as an annular preventer and/or a rotating control device (RCD). The well control devices may be mounted on top of a wellhead 134.

The wellsite system 100 is operable to circulate one or more fluids between the surface equipment 110 and downhole portions of the wellsite system 100 during drilling and other operations. For example, the wellsite system 100 may be operable to inject drilling fluid 140 from the wellsite surface 104 into the wellbore 102 via an internal fluid passage 121 extending longitudinally through the drill string 120. Such wellsite system 100 may comprise a pit, a tank, and/or other fluid container 142 holding the drilling fluid 140, and a pump 144 operable to move the drilling fluid 140 from the container 142 to a port 117 of the top drive 116 via a fluid conduit 146 extending between the pump 144 and the top drive 116. The pump 144 and the container 142 may be fluidly connected by a fluid conduit 191. A flow rate sensor 148 may be operatively connected along the fluid conduit 146 to measure flow rate of the drilling fluid 140 being pumped downhole. The flow rate sensor 148 may be operable to measure volumetric and/or mass flow rate of the drilling fluid 140. The flow rate sensor 148 may be an electrical flow rate sensor operable to generate an electrical signal and/or information indicative of the measured flow rate. The flow rate sensor 148 may be a Coriolis flowmeter, a turbine flowmeter, or an acoustic flowmeter, among other examples. Instead of or in addition to the flow rate sensor 148, a pump stroke counter (not shown) may be mounted in association with the pump 144 and may be utilized to measure volumetric and/or mass flow rate of the drilling fluid 140 being pumped downhole. A fluid level sensor 152 may be connected or otherwise disposed in association with the container 142 and operable to measure level of the drilling fluid 140 within the container 142. The fluid level sensor 152 may be an electrical fluid level sensor operable to generate signals or information indicative of the amount (e.g., level, volume) of drilling fluid 140 within the container 142. The fluid level sensor 152 may comprise conductive, capacitive, vibrating, electromechanical, ultrasonic, microwave, nucleonic, echo, and/or other example sensors. A flow check valve 154 may be connected downstream from the pump 144 to prevent the drilling or other fluids from backing up through the pump 144. A pressure sensor 156 may be connected along the fluid conduit 146, such as to measure pressure of the drilling fluid 140 being pumped downhole. The pressure sensor 156 may be connected close to the top drive 116, such as may permit the pressure sensor 156 to measure pressure within the tool string 120 at the top of the internal passage 121 or otherwise proximate the wellsite surface 104. The pressure sensor 156 may be an electrical sensor operable to generate electric signals and/or other information indicative of the measured pressure.

During drilling operations, the drilling fluid 140 may be pumped through an internal flow pathway (not shown) of the top drive 116 and into the internal passage 121 of the drill string 120. The drilling fluid 140 may continue to flow downhole through the conveyance means 122 and the BHA 124, as indicated by directional arrows 158. The drilling fluid 140 may exit the BHA 124 via ports 128 in the drill bit 126 and then circulate uphole through an annular space ("annulus") 108 of the wellbore 102 defined between an exterior of the drill string 120 and the wall of the wellbore 102, as indicated by direction arrows 159. In this manner, the drilling fluid 140 lubricates the drill bit 126 and carries formation cuttings uphole to the wellsite surface 104. The drilling fluid 140 may exit the annulus 108 via a ported adapter or spool 136 or another tool fluidly connected with the annulus 108. The spool 136 may be disposed below the annular fluid control device 132, above the BOP stack 130, or at another location permitting ported access or fluid connection with the annulus 108. The drilling fluid 140 may be returned via solids control equipment 180 to the container 142 via fluid conduits 162, 164 extending between the spool 136 and the container 142 to be recirculated into the wellbore 102, as described above.

However, during other operations of the wellsite system 100, the flow of the drilling fluid 140 may be reversed (i.e., in a direction opposite the direction indicated by arrow 158), flowing from the wellbore 102 to the wellsite surface 104 via the internal passage 121 of the drill string 120. Thus, a bypass conduit 166 may be connected on opposing sides of the pump 144 and the check valve 154 to permit the reverse flowing drilling fluid 140 to bypass the pump 144 and the check valve 154. A fluid valve 168 may be connected along the bypass conduit 166 to selectively permit flow through the bypass conduit 166. The fluid valve 168 may be a flow rate control valve, such as a needle valve, a metering valve, a globe valve, or another valve operable to progressively or gradually open and close to control rate of fluid flow through the bypass conduit 166. A flow rate sensor 169 may be connected along the bypass conduit 166 to monitor flow rate of the drilling fluid 140 flowing through the bypass conduit 166. The drilling fluid 140 returning to the wellsite surface 104 via the internal passage 121 may be directed to the container 142 via the bypass conduit 166 and the fluid conduit 191.

During drilling operations, the drilling fluid 140 returning to the wellsite surface 104 via the annulus 108 may be directed through a choke manifold 170 connected between the conduits 162, 164. The choke manifold 170 may include two chokes 172 and a plurality of fluid valves 174 operable to determine a flow path through the choke manifold 170. Backpressure may be applied to the annulus 108 by variably restricting flow of the drilling fluid 140 or other fluids through the utilized choke 172. The greater the restriction to flow through the choke 172, the greater the backpressure applied to the annulus 108. Thus, downhole pressure (e.g., pressure at the bottom of the wellbore 102 around the BHA 124 or at a particular depth along the wellbore 102) can be regulated by varying the backpressure at an upper (i.e., uphole) end (e.g., within an upper portion) of the annulus 108 proximate the wellsite surface 104. Pressure maintained at the upper end of the annulus 108 may be measured via a pressure sensor 176 connected along the conduit 162 between the spool 136 and the choke manifold 170 and, thus, in communication with the upper end of the annulus 108. A fluid valve 178 may be connected along the conduit 162 to selectively fluidly isolate the annulus 108 from the choke manifold 170 and/or other surface equipment 110 fluidly connected with the conduit 162. Before being returned to the container 142, the drilling fluid 140 may be cleaned by the solids control equipment 180, such as may include one or more of shakers, separators, centrifuges and other mud cleaning devices. A flow rate sensor 182 may be connected along the fluid conduit 164 to monitor flow rate of the drilling fluid 140 or another fluid being returned into the container 142. A fluid valve 184 may be connected along the conduit 164 to selectively fluidly isolate the choke manifold 170 from the fluid container 142.

When the flow of the drilling fluid 140 is reversed, the drilling fluid 140 returning to the wellsite surface 104 via the drill string 120 may be diverted to flow through the choke manifold 170 to provide pressure control of the returning drilling fluid 140. For example, a fluid conduit 186 may be connected between the fluid conduit 146 and the fluid conduit 162 to transfer the exiting drilling fluid 140 toward the choke manifold 170. A fluid valve 188 may be connected along the conduit 186 to selectively fluidly connect the conduits 146, 162 and, thus, facilitate the returning drilling fluid 140 to be diverted through the choke manifold 170.

When the flow of the drilling fluid 140 is reversed, the drilling fluid 140 returning to the wellsite surface 104 via the drill string 120 may be directed to another fluid container 190 instead of or in addition to the fluid container 142. An inlet of the container 190 may be fluidly connected with the conduit 191 via a conduit 192, such as may permit the container 190 to receive the drilling fluid 140 returning via the bypass conduit 166. The inlet of the container 190 may also or instead be fluidly connected with an outlet of the choke manifold 170 via a conduit 193, such as may permit the container 190 to receive the drilling fluid 140 returning via the choke manifold 170. Fluid valve 194 along the conduit 192 may be opened and fluid valve 195 along the conduit 191 may be closed to direct the drilling fluid 140 returning via the bypass conduit 166 into the container 190. Fluid valve 196 connected along the conduit 193 may be opened and the fluid valve 184 along the conduit 164 may be closed to direct the drilling fluid 140 returning via the choke manifold 170 into the container 190. A flow rate sensor 197 may be connected along the fluid conduit 193 to monitor flow rate of the drilling fluid 140 being transferred into the container 190. A fluid level sensor 198 may be connected or otherwise disposed in association with the container 190 and operable to measure level of the drilling fluid 140 transferred into the container 190. The drilling fluid 140 within the container 190 may be discharged into the container 142 by opening a fluid valve 199 connected between an outlet of the container 190 and the container 142.

The wellsite system 100 may be further operable to inject a displacement fluid into the annulus 108 to displace the drilling fluid 140 out of the wellbore 102 to the wellsite surface 104 via the internal passage 121 of the drill string 120. The wellsite system 100 may comprise a container 204 holding a displacement fluid 206 and a pump 208 operable to move the displacement fluid 206 from the container 204 into the annulus 108 via a fluid conduit 210. The conduit 210 may be fluidly connected with the annulus 108 via the spool 136 or another tool fluidly connected with the annulus 108.

The displacement fluid 206 held within the container 204 may be a liquid having a specific gravity that is less than the specific gravity of the drilling fluid 140. For example, the displacement fluid 206 may be or comprise diesel or naphtha. The displacement fluid 206 may be or comprise a liquefied gas, such as nitrogen, air or other gases, which also has a specific gravity that is less than the specific gravity of the drilling fluid 140. A heat exchanger or a converter 212 may be connected along the conduit 210 between the pump 208 and the spool 136. The converter 212 may be operable to increase the temperature of the displacement fluid 206 or otherwise gasify the displacement fluid 206. Accordingly, one or more of the pump 208 and the converter 212 may be or comprise a nitrogen converter unit. Instead of utilizing the container 204 to hold a liquefied gas, or compressed air, or a mixture of gases, an air compressor may be utilized to capture and pressurize air from the ambient atmosphere and inject the air into the annulus 108. A nitrogen generator unit may also be utilized to compress and separate air captured from the ambient atmosphere to provide pressurized nitrogen gas for injection into the annulus 108. The utilized one or more of the container 204, the pump 208, the converter 212, the nitrogen converter unit, the air compressor, and the nitrogen generator may be referred to hereinafter as a source 202 of displacement fluid 206.

A flow rate sensor 214 may be connected along the fluid conduit 210 to monitor flow rate of the displacement fluid being injected into the annulus 108. A fluid level sensor 216 may be connected or otherwise disposed in association with the fluid container 204 and operable to generate signals or information indicative of the amount of the displacement fluid 206 contained the container 204. A fluid valve 218 may be connected between the source of displacement fluid 202 and the spool 136 to selectively fluidly isolate the source of displacement fluid 202 and the annulus 108. Pressure of the displacement fluid 206 being injected into the annulus 108 may be measured via a pressure sensor 220 connected along the conduit 210 adjacent the spool 136 and, thus, in communication with the annulus 108.

A level sensor 135 may be mounted in association with the wellhead 134, the BOP stack 130, the spool 136, and/or the casing to detect drilling fluid level (i.e., depth of drilling fluid interface) within the annulus 108. Such level sensor 135 may be operable to measure distance to the drilling fluid interface within the annulus 108 and, thus, utilized to measure the volume of the drilling fluid evacuated from the wellbore 102.

The wellsite system 100 may be further operable to bleed or otherwise discharge the displacement fluid 206 from the annulus 108. For example, a liquid displacement fluid 206 may be bled through the choke manifold 170 into one or more of the containers 142, 190. A gaseous displacement fluid 206 may be bled from the annulus 108 into the ambient atmosphere above or proximate the wellsite surface 104. For example, the gaseous displacement fluid 206 (e.g., nitrogen, air) may be directed into the choke manifold 170 and bled into the ambient atmosphere via an exhaust conduit 222 connected with an outlet of the choke manifold 170. A degasser of the solids control equipment 180 may also or instead be utilized to bleed the displacement fluid 206 from the annulus 108. Prior to bleeding the displacement fluid 206 from the annulus 108, the various fluid valves 174 of the choke manifold 170 may be operated or otherwise configured to fluidly connect the fluid conduit 162 and the exhaust conduit 222. The choke assembly 170 may be utilized to control the rate at which the displacement fluid 206 is bled. A bleed valve 224 may also or instead be fluidly connected with the annulus 108 proximate the wellsite surface 104 to control the rate at which the gaseous displacement fluid 206 is bled into the ambient atmosphere. The bleed valve 224 may be a flow rate control valve, such as a needle valve, a metering valve, a globe valve, or another valve operable to progressively or gradually open and close to control rate of fluid flow. Although the bleed valve 224 is shown fluidly connected downstream from the choke manifold 170, along the exhaust conduit 222, the bleed valve 224 may be fluidly connected with one of the fluid conduits 162, 186, 210 independent of the choke manifold 170.

The ability to evacuate the drilling fluid 140 and the displacement fluid 206 from the wellbore 102 to the wellsite surface 104 via the choke manifold 170 provides a well control (i.e., pressure) barrier to the wellsite system 100, in addition to the wellbore hydrostatic pressure generated by the drilling fluid. When evacuating the drilling fluid 140 via the drill string 120 or bleeding the displacement fluid 206 from the annulus 108, a controlled and pre-determined hydrostatic pressure change (e.g., a reduction in hydrostatic pressure) in the wellbore 102 may be maintained via the choke manifold 170. Although unintended, such fluid evacuation may cause inflow of formation fluid into the wellbore (i.e., a kick) when the exerted hydrostatic pressure becomes lower than the formation pore pressure, which may cause fluids within the wellbore 102 to become pressurized. The choke manifold 170 may control such pressure at the wellsite surface 104 and/or prevent such fluids from being discharged from the wellbore 102.

A exhaust valve 226 may be fluidly connected with an upper (i.e., uphole) end of the internal passage 121, such as may be operable to selectively fluidly connect the upper end of the internal passage 121 with the ambient atmosphere above or proximate the wellsite surface 104. The exhaust valve 226 may permit the upper end of the internal passage 121 to receive air from the ambient atmosphere and, thus, be maintained at atmospheric pressure, such as when the displacement fluid 206 is bled from the annulus 108. The exhaust valve 226 may be directly or indirectly fluidly connected with the fluid conduit 146 and operable to fluidly connect the fluid conduit 146 and, thus, the upper end of the internal passage 121 with the ambient atmosphere via the top drive port 117. The exhaust valve 226 may be fluidly connected along an exhaust conduit 228 fluidly connected directly or indirectly with the fluid conduit 146, such as along the fluid conduit 186. Instead of or in addition to the exhaust valve 226, ambient air may be exhausted from or received into the internal passage 121 via the top drive 116, a standpipe manifold (not shown), the choke manifold 170, a degasser (e.g., a flare) of the solids treatment equipment 180, and/or the mud tanks 142, 190.

The fluid valves described above, may be or comprise fluid shut-off valves, such as ball valves, globe valves, and/or other types of fluid valves, which may be selectively opened and closed to permit and prevent fluid flow therethrough. The fluid valves may be actuated remotely by corresponding actuators operatively coupled with the fluid valves. The actuators may be or comprise electric actuators, such as solenoids or motors, or fluid actuators, such as pneumatic or hydraulic cylinders or rotary actuators. The fluid valves may also or instead be actuated manually, such as by corresponding levers.

The surface equipment 110 of the wellsite system 100 may also comprise a control center 230 from which various portions of the wellsite system 100 may be monitored and controlled. The control center 230 may be located on the rig floor 115 or another location at the wellsite surface 104. The control center 230 may contain or comprise a controller 232 operable to provide control to one or more portions of the wellsite system 100 and/or operable to monitor operations of one or more portions of the wellsite system 100. For example, the controller 232 may be communicatively connected with the various surface and downhole equipment describe herein and operable to receive signals from and transmit signals to such equipment to perform various operations described herein. The controller 232 may include an input device for receiving commands from a human operator 234 and an output device for displaying information to the human operator 234. The controller 232 may store executable programs and/or instructions, including for implementing one or more aspects of the operations described herein. Communication between the control center 230, the controller 232, and the various wellsite equipment may be via wired and/or wireless communication means. However, for clarity and ease of understanding, such communication means are not depicted, and a person having ordinary skill in the art will appreciate that such communication means are within the scope of the present disclosure.

The BHA 124 connected at the lower end of the conveyance means 122 may include various downhole tools 242, 244, 246, 248. One or more of the downhole tools 242, 244, 246, 248 may be or comprise an acoustic tool, a density tool, a directional drilling tool, an electromagnetic (EM) tool, a sampling while drilling (SWD) tool, a formation testing tool, a formation sampling tool, a gravity tool, a monitoring tool, a neutron tool, a nuclear tool, a photoelectric factor tool, a porosity tool, a reservoir characterization tool, a resistivity tool, a seismic tool, a surveying tool, and/or a tough logging condition (TLC) tool, although other downhole and drilling tools, devices, ported subs are also within the scope of the present disclosure. One or more of the downhole tools 242, 244, 246, 248 may also be implemented as a measuring-while-drilling (MWD) or logging-while-drilling (LWD) tool for the acquisition and/or transmission of downhole data to the wellsite surface 104.

The downhole tool 242 may be or comprise a ported sub, such as may selectively permit fluid communication between the internal passage 121 and the annulus 108. An example ported sub may comprise a sleeve 252 slidably disposed about a plurality of ports 254 extending radially through the ported sub. The sleeve 252 may be selectively moved, as indicated by arrows 256, to expose the ports 254 and, thus, permit fluid communication between the internal passage 121 and the annulus 108. The sleeve 252 may be actuated by a ball (not shown) deposited into the internal passage 121 from the wellsite surface 104 and operable to flow downhole into the ported sub to move the sleeve 252 to open the ports 254. The sleeve 252 may also be electrically or hydraulically operated between the open and closed positions, such as via an electrical or hydraulic mechanism (not shown) located within the ported sub 242.

The downhole tool 244 may be or comprise an MWD or LWD tool comprising a sensor package 262 operable for the acquisition of measurement data pertaining to the BHA 124, the wellbore 102, and/or the formation 106. The downhole tool 244 and/or another portion of the BHA 124 may also comprise a telemetry device 264 operable for communication with the controller 232 or other surface equipment, such as via mud-pulse telemetry. The downhole tool 244 and/or another portion of the BHA 124 may also comprise a downhole controller 266 operable to receive, process, and/or store information received from the controller 232, the sensor package 262, and/or other portions of the BHA 124. The controller 266 may also store executable programs and/or instructions, including for implementing one or more aspects of the operations described herein.

The downhole tool 246 may be or comprise a check valve or another fluid valve operable to permit downhole fluid flow via the internal passage 121, as indicated by arrows 158, but not uphole flow via the internal passage 121. Accordingly, the downhole tool 246 may prevent the drilling fluid 140 from flowing into the internal passage 121 via the ports 128 of the drill bit 126. The downhole tool 246 may comprise a flapper 268 pivotably disposed within the internal passage 121 and operable to move between open and closed positions, as indicated by arrows 269. The flapper 268 may remain open, as shown in FIG. 1, when the drilling fluid is flowing downhole, as indicated by arrows 158, and close if the drilling fluid attempts to enter the internal passage 121 via the drill bit 126 and flow uphole. The flapper 268 may be biased toward the closed position. Instead of having a flapper 268, downhole tool 246 may be or comprise a float valve utilizing a floating ball operable to selectively move against a seat to close the internal passage 121 to prevent backflow of the drilling fluid 140 through the drill bit 126. The flapper 268 may also be electrically or hydraulically operated between the open and closed positions, such as via an electrical or hydraulic mechanism (not shown) located within the downhole tool 246. Although the downhole tool 246 is shown as part of the BHA 124, one or more downhole tools 246 may also or instead be connected along the conveyance means 122, such as between adjacent drill pipes, at a distance uphole from the BHA 124. The downhole tool 248 may be or comprise one or more drill collars connected with the drill bit 126.

As described further below, the ported sub 242 may be utilized to bypass the downhole tool 246 to permit flow from the annulus 108 into the internal passage 121. However, if the ported sub is not installed, other means of by-passing the downhole tool 246 may be implemented. For example, a mechanical back-off within the drill string 120 may be performed, such that a disconnected drill pipe allows entry of the drilling fluid into the internal passage 121. A wireline conveyed hole punch (e.g., punching a series of three to six perforation holes) may be perform in the drill string 120 at a depth below the anticipated lowest point of circulation to by-pass the downhole tool 246 to allow entry of the drilling fluid into the internal passage 121. A mechanical drill pipe back-off may be performed to install the ported sub 242.

Figure 2:
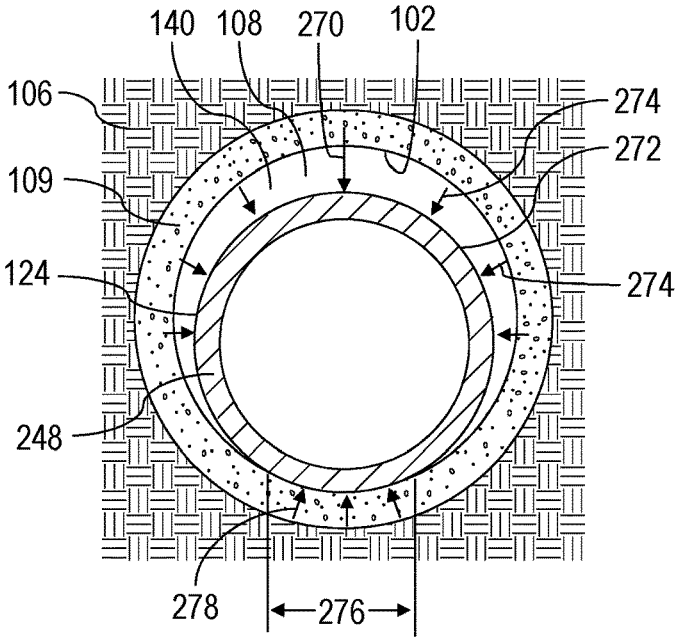
FIG. 2 is a sectional view of an example implementation of a portion of the apparatus shown in FIG. 1 according to one or more aspects of the present disclosure.
Figure 3:
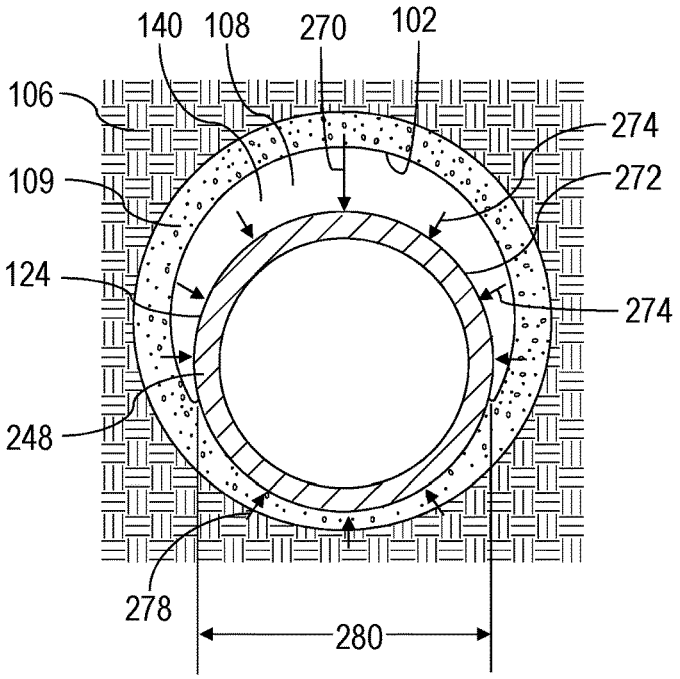
FIG. 3 is a sectional view of an example implementation of a portion of the apparatus shown in FIG. 1 according to one or more aspects of the present disclosure.

FIGS. 2 and 3 are sectional axial views of the wellbore 102 and the drill collar 248 of the BHA 124 shown in FIG. 1 at different stages of differential pressure sticking. As described above, differential pressure sticking is caused by a differential between pressure of the formation 106 and the hydrostatic pressure within the wellbore 102. When the hydrostatic pressure within the wellbore 102 is higher than the pressure of the formation 106, a net force 270 may be imparted to a portion of the drill string 120 in contact with filter cake 109 located along a sidewall of the wellbore 102. Outer surface area 272 of the drill collar 248 or other portions of the BHA 124 that is not embedded within the filter cake 109 is subjected to the hydrostatic pressure 274 of the drilling fluid 140 and other fluid around the drill collar 248, while outer surface area 276 embedded within or otherwise in contact with the filter cake 109 is subjected to a pressure 278 of the filter cake 109. The pressure 278 of the filter cake 109 may be the formation pressure or another pressure lower than the hydrostatic pressure 274, which may vary based on radial distance from the formation 106.

When the drill string 120 contacts the filter cake 109 over a relatively small surface area 276 of the BHA 124, as shown in FIG. 2, friction is created between the drill string 120 and the filter cake 109, resulting in friction being applied to the drill string 120. However, once the drill string 120 contacts the filter cake 109 over a relatively larger surface area 280 (i.e., the drill collar 248 and/or other portions of the BHA 124 is substantially embedded within the filter cake 109), as shown in FIG. 3, the friction may exceed the maximum pulling force (i.e., tension) that may be generated by the tensioning device of the wellsite structure 112, causing the drill string 120 to stick, immobilizing the drill string 120.

Mathematical equations, such as Equations (1)-(12) listed below, may be applied to determine various operational parameters that may be utilized to free a drill string stuck within a wellbore caused by differential pressure sticking. For example, a pulling force (i.e., tension) may be applied to a drill string from a wellsite surface to free the drill string stuck within a wellbore caused by differential pressure sticking. Such pulling force may be determined by utilizing Equation (1).

$$F_{pull}=W_{ds}-F_f \tag{1}$$

where $F_{pull}$ is the pulling force operable to free the drill string, $W_{ds}$ is the weight of the drill string, and $F_f$ is the friction force applied to the drill string caused by differential pressure sticking.

The friction force $F_f$ applied to the drill string may be determined by utilizing Equation (2).

$$F_f=(P_h-P_f)A\mu \tag{2}$$

where $P_h$ is the hydrostatic pressure within the wellbore at depth where differential pressure sticking is occurring, $P_f$ is the formation pressure within the wellbore at depth where differential pressure sticking is occurring, A is an estimated surface area of contact between filter cake and the drill string, and μ is an estimated coefficient of friction between the drill string and the filter cake.

The hydrostatic pressure $P_h$ may be determined by utilizing Equation (3).

$$P_h=\rho gh \tag{3}$$

where ρ is density of the drilling and other fluid within the wellbore, g is the gravitational constant, and h is height of the fluid column within the wellbore at depth where differential pressure sticking is occurring. The height h utilized in the Equation (3) is the true vertical depth (TVD) between the upper surface of the fluid column and the depth where differential pressure sticking is occurring.

Accordingly, the pulling force $F_{pull}$ operable to free the drill string stuck within the wellbore caused by differential pressure sticking may be determined by utilizing Equation (4).

$$F_{pull}=W_{ds}+(\rho gh-P_f)A\mu \tag{4}$$

Based on Equation (4), the pulling force $F_{pull}$ operable to free the drill string stuck within the wellbore caused by differential pressure sticking may be reduced by decreasing the hydrostatic pressure $P_h$ within the wellbore. The hydrostatic pressure $P_h$ may be reduced by replacing a sufficient amount of drilling fluid within the wellbore with a liquid having a density that is less than density ρ of the drilling fluid within the wellbore. The hydrostatic pressure $P_h$ may also be reduced by displacing or otherwise evacuating a predetermined amount of the drilling fluid from the wellbore to decrease the height h of the drilling fluid column within the wellbore at depth where differential pressure sticking is occurring.

The height of the drilling fluid column within the wellbore that may permit the surface equipment to pull and free the drill string may be determined by utilizing Equation (5).

$$F_{max}=W_{ds}+(\rho gh_{target}-P_f)A\mu \tag{5}$$

where $F_{max}$ is the maximum pulling force (i.e., tension) that can be generated by the surface equipment, and $h_{target}$ is the height of the fluid column within the wellbore resulting in a hydrostatic pressure that permits the maximum pulling force $F_{max}$ to free the stuck drill string.

Thus, in order to free the stuck drill string, the height h of the fluid column within the wellbore may be decreased by a height determined by utilizing Equation (6).

$$h_{decrease}=h-h_{target} \tag{6}$$

where $h_{decrease}$ is the height by which the original fluid column height h has to be decreased to permit the maximum pulling force $F_{max}$ of the rig to free the stuck drill string.

Once the height $h_{decrease}$ is determined, volume of the drilling fluid that is to be evacuated from the wellbore to decrease the height h by the height $h_{decrease}$ may be calculated by utilizing Equations (7) and (8).

$$V=h_{decrease}(A_{wb}-A_{ds}+A_{fp}) \tag{7}$$

$$V=h_{decrease}(\pi d_{wb}^2/4-\pi d_{ds}^2/4+\pi d_{fp}^2/4) \tag{8}$$

where V is the volume of the drilling fluid to be evacuated from the wellbore, $A_{wb}$ is the area of the wellbore, $A_{ds}$ is the area of the drill string, $A_{fp}$ is the area of the fluid pathway extending through the drill string, $d_{wb}$ is an estimated inner diameter of the wellbore, $d_{ds}$ is the outer diameter of the drill string, and $d_{fp}$ is inner diameter of the fluid pathway extending through the drill string. Thus, once the volume V of the drilling fluid has been evacuated from the wellbore, the maximum pulling force $F_{max}$ applied by the rig may be sufficient to overcome the friction $F_f$ to free the stuck drill string.

Instead of applying a pulling force $F_{pull}$ to free a drill string stuck within a wellbore caused by differential pressure sticking, a right-hand (i.e., clockwise) torque may be applied to the drill string from a wellsite surface to free the drill string. Such torque may be determined by utilizing Equation (9).

$$T=F_f \tag{9}$$

where T is the right-hand torque operable to free the drill string and $F_f$ is the friction force applied to the drill string caused by differential pressure sticking. The friction force $F_f$ applied to the drill string may be determined by utilizing Equations (2) and (3) listed above.

Equations (2), (3), and (9) may be combined as Equation (10), which may be utilized to determine the torque T operable to free the drill string stuck within the wellbore caused by differential pressure sticking.

$$T=(\rho gh-P_f)A\mu \tag{10}$$

Based on Equation (10), the torque T may be reduced by decreasing the hydrostatic pressure $P_h$ within the wellbore. Similarly as described above, the hydrostatic pressure $P_h$ may be reduced by replacing a sufficient amount of drilling fluid within the wellbore with a liquid having a density that is less than density ρ of the drilling fluid within the wellbore. The hydrostatic pressure $P_h$ may also be reduced by displacing or otherwise evacuating a predetermined amount of the drilling fluid from the wellbore to decrease the height h of the drilling fluid column within the wellbore at depth where differential pressure sticking is occurring.

Thus, the height of the drilling fluid column within the wellbore that may permit the surface equipment to apply the torque to free the drill string may be determined by utilizing Equation (11).

$$T_{max}=(\rho gh_{target}-P_f)A\mu \tag{11}$$

where $T_{max}$ is the maximum right-hand torque that can be generated by the surface equipment, and $h_{target}$ is the height of the fluid column within the wellbore resulting in a hydrostatic pressure that permits the maximum torque $T_{max}$ to free the stuck drill string.

In order to permit the maximum torque $T_{max}$ applied by the rig to free the stuck drill string, the height h of the drilling fluid column within the wellbore may be decreased by a height $h_{decrease}$, which may be determined by utilizing Equation (6) listed above. Once the height $h_{decrease}$ is determined, a volume V of the drilling fluid that is to be evacuated from the wellbore to decrease the height h of the drilling fluid column by the height $h_{decrease}$ may be determined by utilizing Equations (7) and (8) listed above. Thus, once the volume V of the drilling fluid has been evacuated from the wellbore, the maximum torque $T_{max}$ applied by the rig may be sufficient to overcome the friction $F_f$ to free the stuck drill string.

A combination of pulling force $F_{pull}$ and right-hand torque T may also be applied to a drill string from a wellsite surface to free the drill string stuck within a wellbore caused by differential pressure sticking. Based on the maximum pulling force $F_{max}$ and the maximum torque $T_{max}$ of the surface equipment (i.e., the rig), a maximum total force $F_{maxtotal}$ that can be applied to the drill string may be determined. Such force $F_{maxtotal}$ may be determined by calculating the vector sum of the maximum pulling force $F_{max}$ and the maximum torque $T_{max}$ by utilizing Equation (12).

$$F_{maxtotal}=\sqrt{F_{max}^2+T_{max}^2} \quad (12)$$

where $F_{maxtotal}$ is the maximum total force (i.e., combination of tension and right-hand torque) that may be generated by the surface equipment, $F_{max}$ is the maximum pulling force that can be generated by the surface equipment, and $T_{max}$ is the maximum right-hand torque that can be generated by the surface equipment.

Once the maximum total force $F_{maxtotal}$ is determined, Equations (5) and (11) can be plugged into Equation (12), which may then be solved to determine the height $h_{target}$ of the fluid column within the wellbore resulting in a hydrostatic pressure that permits the maximum total force $F_{maxtotal}$ to free the stuck drill string. Once the height $h_{target}$ is known, the height h of the fluid column within the wellbore may be decreased by a height $h_{decrease}$, which may be determined by utilizing Equation (6) listed above. Thereafter, a volume V of the drilling fluid that is to be evacuated from the wellbore to decrease the height h of the drilling fluid column by the height $h_{decrease}$ may be determined by utilizing Equations (7) and (8) listed above. Thus, once the volume V of the drilling fluid has been evacuated from the wellbore, the maximum total force $F_{maxtotal}$ applied by the rig may be sufficient to overcome the friction $F_f$ to free the stuck drill string.

The present disclosure is further directed to methods and operations utilized to decrease the hydrostatic pressure within a wellbore, such as may permit a differentially stuck drill string to be freed. FIGS. 4-7 are schematic views of a wellsite system 300 comprising the drill string 120 stuck within a wellbore 102 caused by differential pressure sticking during successive stages of operations to free the drill string. Such operations may be referred to hereinafter as freeing operations. The wellsite system 300 comprises one or more similar features of the wellsite system 100, including where indicated by like reference numbers, but is simplified for ease of understanding. The following description refers to FIGS. 1-7, collectively.

Before initiating the freeing operations, the various parameters (i.e., variables) utilized in the Equations (1)-(12) related to the wellbore 102, the formation 106, and the drill string 120 may be ascertained. Thereafter, the operational parameters of the freeing operations may be determined via the Equations (1)-(12). For example, the target height $h_{target}$ of the drilling fluid 140 resulting in a hydrostatic pressure 274 that permits freeing of the drill string 120 by the surface tensioning and/or rotating devices (e.g., the top drive 116) may be determined. Once the target height $h_{target}$ is determined, the target volume V of the drilling fluid 140 to be evacuated from the wellbore 102 to achieve the target height $h_{target}$ may be determined. Before initiating the freeing operations, the specific gravity or the average density ρ of the drilling fluid 140 within the wellbore 102 may also be reduced, which may reduce the target volume V of the drilling fluid 140 to be evacuated from the wellbore 102. For example, the drilling fluid 140 may be circulated through the solids control equipment 180 to remove drill cuttings from the drilling fluid. The drilling fluid 140 may also be circulated through a centrifuge or another separator to remove drilling fluid solids, such as barite, to further reduce the specific gravity of the drilling fluid 140 within the wellbore 102.

Figure 4:
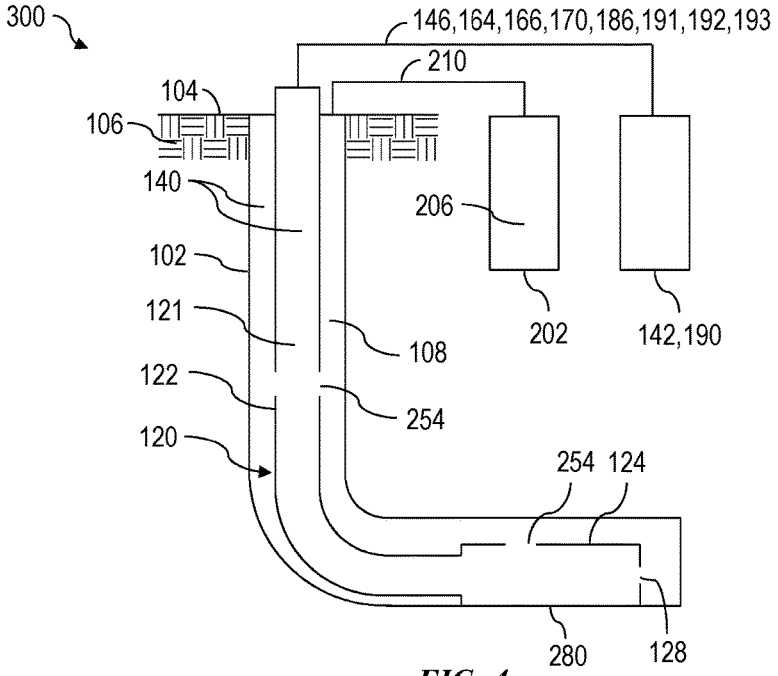
FIGS. 4-7 are schematic views of a portion of apparatus according to one or more aspects of the present disclosure at different stages of operation.

FIG. 4 shows the drill string 120 differentially stuck within the wellbore 102 along the contact area 280 between sidewall of the wellbore 102 and portions of the BHA 124 of the drill string 120. Both the annulus 108 and the internal passage 121 are entirely filled with the drilling fluid 140. The displacement fluid source 202 may be fluidly connected with the annulus 108, such as via the fluid conduit 210 and the spool 136. The annular fluid control device 132 and the valve 178 may be closed, the BOP stack 130 and the valve 218 may be opened, and at least one of the downhole tools 242, 246 may be opened. As described above, an instance of the downhole tool 242 having ports 254 may also or instead be connected along the conveyance means 122 at a distance uphole from the BHA 124. The tensioning device of the wellsite structure 112 (e.g., the rig) may apply tension to the drill string 120 and the top drive 116 may apply right-hand torque to the drill string 120 to support the exerted freeing action with maximum allowable mechanical force. The fluid displacement source 202 may then be operated to inject a gas displacement fluid 206 (hereinafter "gas") into the annulus 108.

Figure 5:
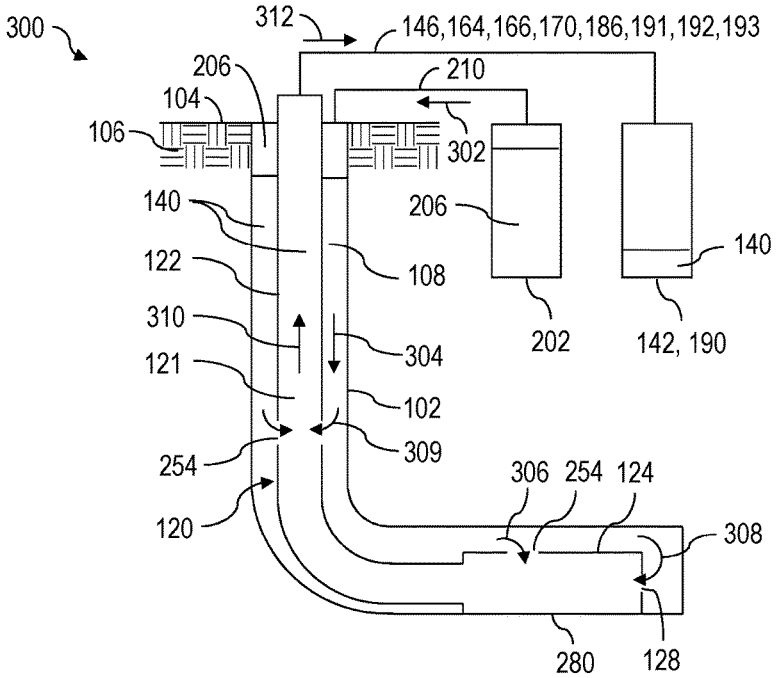

FIG. 5 shows the gas 206 flowing from the source 202 into the annulus 108 as indicated by arrow 302. The gas 206 displaces the drilling fluid 140 within the annulus 108 lowering the height of the drilling fluid 140 within the annulus 108 and forcing the drilling fluid 140 to flow in the downhole direction, as indicated by arrow 304. If the downhole tool 242 is open, than the drilling fluid 140 may enter the internal passage 121 of the drill string 120 via the ports 254, as indicated by arrow 306. If the downhole tool 246 is open, than the drilling fluid 140 may enter the internal passage 121 of the drill string 120 via the ports 128 of the drill bit 126, as indicated by arrow 308. However, if the ports 128 are blocked or clogged by cuttings or other wellbore sediment, the drilling fluid 140 may enter into the internal passage 121 just via the ports 254. If an instance of the downhole tool 242 is connected along the conveyance means 122 at a distance uphole from the BHA 124, such downhole tool 242 may be opened to permit the drilling fluid 140 to enter the internal passage 121 via the corresponding ports 254 at an intermediate height between the wellsite surface 104 and the BHA 124, as indicated by arrows 309. The drilling fluid 140 may then flow in the uphole direction via the internal passage 121, as indicated by arrow 310. The drilling fluid 140 may flow into one or more of the fluid containers 142, 190, as indicated by arrow 312. The drilling fluid 140 may be directed to return through the choke manifold 170 by closing the valve 168 and opening the valve 188. The drilling fluid 140 may than be directed into the container 190 by opening the valve 196 and closing the valve 184 or the drilling fluid 140 may be directed into the container 142 by opening the valve 184 and closing the valve 196. The drilling fluid 140 may be directed to return through the bypass conduit 166 and not through the choke manifold 170 by closing the valve 188 and opening the valve 168. The drilling fluid 140 may then be directed into the container 190 by opening the valve 194 and closing the valves 195, 196 or the drilling fluid 140 may be directed into the container 142 by opening the valve 195 and closing the valves 194, 199.

The volume of the drilling fluid 140 evacuated from the wellbore 102 via the internal passage 121 may be monitored in real-time via the level sensors 135, 152, 198 and/or the flow rate sensors 169, 182, 197, and the volume of the gas 206 injected into the annulus 108 may be monitored in real-time via the level sensor 216 and/or the flow rate sensor 218. The volume of the drilling fluid 140 evacuated from the wellbore 102 and the volume of the gas 206 injected into the annulus 108 may be determined (e.g., via the controller 232), based on the signals generated by one or more of the level sensors 135, 152, 198, 216 and/or the flow rate sensors 169, 182, 197, 214, substantially continuously or at predetermined time intervals during the freeing operations. The pressure of the drilling fluid 140 being discharged via the internal passage 121 may be monitored in real-time via the pressure sensor 156 and the pressure of the gas 206 injected into the annulus 108 may be monitored in real-time via the pressure sensor 220. The source 202 of the gas 206 may be operated such that the pressure of the injected gas 206 does not exceed previously established formation integrity test pressure or the leak-off test pressure. The source 202 may be operated until the target volume of drilling fluid 140 is evacuated from the wellbore 102, at which time the human operator 234 or one or more of the controllers 232, 266 may cause the source 202 to halt or stop injection of the gas 206.

Figure 6:
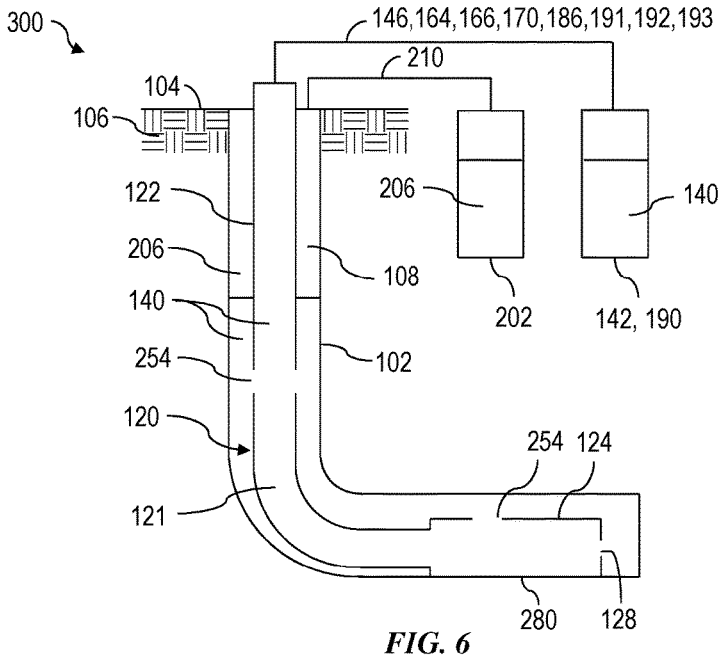
Figure 7:
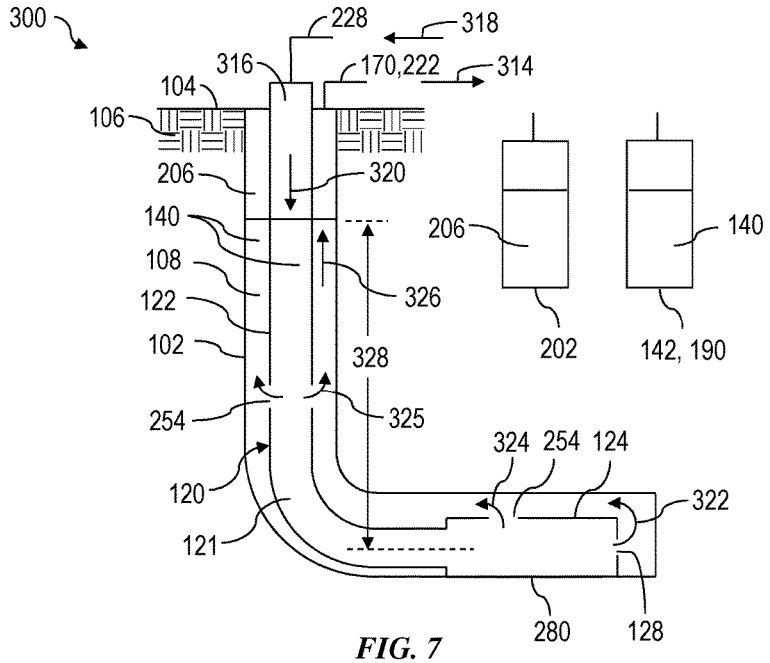

FIG. 6 shows the wellsite system 300 when the target volume of drilling fluid 140 is evacuated from the upper portion of the annulus 108 into one or more of the containers 142, 190 and the source 202 has stopped injecting the gas into the annulus 108. Referring now to FIG. 7, after the source 202 has stopped operating, the valve 218 may be closed and the source 202 may be fluidly disconnected from the annulus 108. The valves 178, 224 may be opened to permit the gas 206 within the annulus 108 to be bled to the ambient atmosphere via the exhaust conduit 222, as indicated by arrow 314. The valves 168, 188 may be closed to fluidly disconnect the containers 142, 190 from the internal passage 121 and the exhaust valve 226 may be opened to open the top of the internal passage 121 of the drill string 120 to the ambient atmosphere, such as may permit air 316 to enter the top of the drill string 120 via the fluid conduit 228, as indicated by arrow 318. Accordingly, the top of the internal passage 121 may be maintained at atmospheric pressure as the gas 206 is bled from the annulus 108. The gas 206 may be bled in a controlled manner by adjusting the flow rate of the escaping gas via the choke manifold 170 and/or the bleed valve 224. The pressure of the air 316 within the top portion of the internal passage 121 may be monitored in real-time via the pressure sensor 156 and the pressure of the gas 206 within the top portion of the annulus 108 may be monitored in real-time via the pressure sensor 176.

As the gas 206 is bled in a controlled manner from the top of the annulus 108, pressure within the top of the annulus 108 decreases, permitting the height or level of the drilling fluid 140 within the internal passage 121 equalize in a controlled manner with the height or level of the drilling fluid 140 within the annulus 108. Accordingly, the drilling fluid 140 within the top of the internal passage 121 moves in the downhole direction, as indicated by arrow 320, and into the annulus 108 via one or more of the ports 128, 254, as indicated by arrows 322, 324, 325, respectively. However, if the ports 128 are blocked or clogged by cuttings or other wellbore sediments, the drilling fluid 140 may flow from the internal passage 121 into the annulus 108 via just the ports 254. The drilling fluid 140 continues to flow in the uphole direction, as indicated by arrow 326, similarly to a fluid u-tubing process. As the pressure of the gas 206 within the annulus 108 decreases, the hydrostatic pressure at the BHA 124 also decreases, reducing differential pressure sticking force (i.e., friction) holding the BHA 124 against the sidewall of the wellbore 102. Tension and/or right-hand torque may be continuously applied to the drill string 120 as the gas 206 is bled from the annulus 108. Thus, when the hydrostatic pressure decreases to a level that can be overcome by the tension and torque applied to the drill string 120, the BHA 124 is pulled away and freed from the sidewall of the wellbore 102. Once the gas 206 is fully bled, the top of the annulus 108 and the top of the internal passage 121 are at atmospheric pressure and the drilling fluid heights within the annulus 108 and the internal passage 121 equalize at the target height 328.

If the tension and/or torque applied to the drill string 120 was able to free the drill string 120 before the gas 206 was fully bled, the rig operations performed prior to getting stuck may be resumed or the drill string 120 may be pulled back or out of the wellbore 102 for inspection. However, if the tension and/or torque applied to the drill string 120 was not able to free the drill string 120, a new target height may be calculated and the above operations repeated to evacuate enough drilling fluid 140 to reach the new target height.

The methods and/or operations described above may be performed utilizing or otherwise in conjunction with at least a portion of one or more implementations of one or more instances of the apparatus shown in one or more of FIGS. 1-7 and/or otherwise within the scope of the present disclosure. However, the operations may also be performed in conjunction with implementations of apparatus other than those depicted in FIGS. 1-7 that are also within the scope of the present disclosure. The operations may be performed manually by one or more wellsite operators 234 and/or performed or caused, at least partially, by the controller 232 executing coded instructions according to one or more aspects of the present disclosure. For example, the controller 232 may receive input signals and automatically generate and transmit output signal to operate or cause a change in an operational parameter of one or more pieces of the wellsite equipment described above. The human operator 234 may also or instead manually operate the one or more pieces of wellsite equipment via the controller 232 based on sensor signals displayed.

Figure 8:
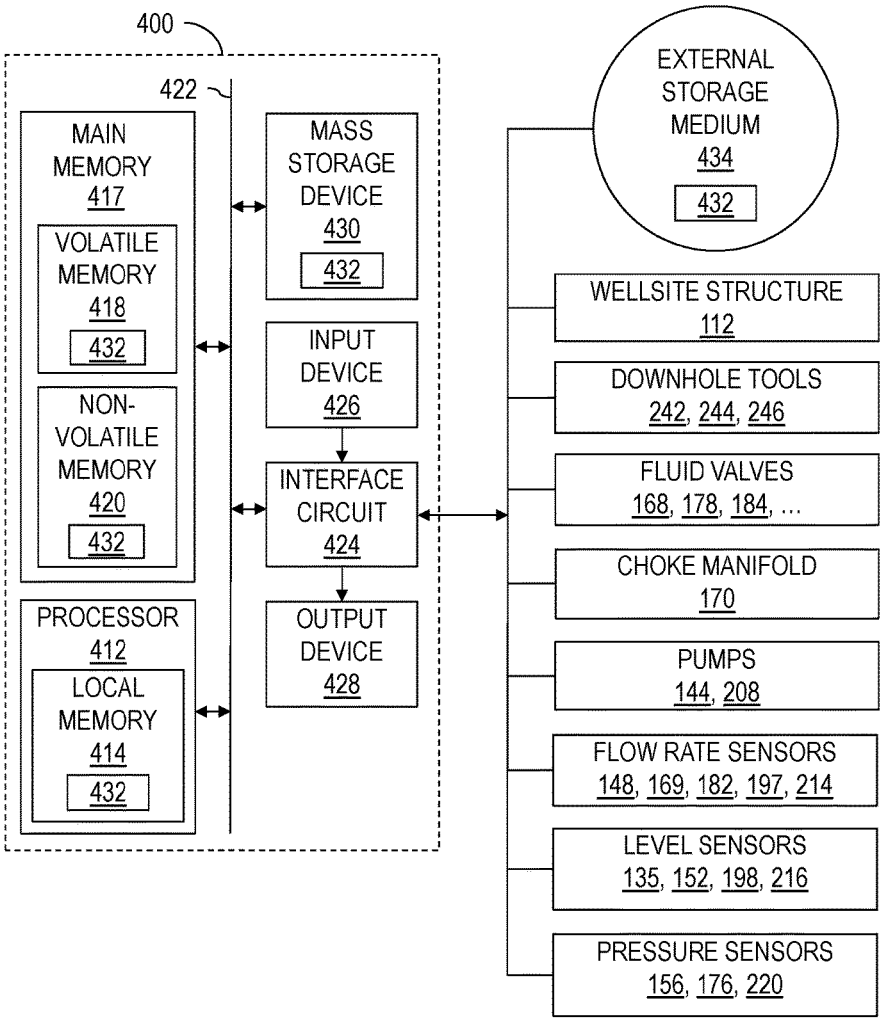
FIG. 8 is a schematic view of at least a portion of an example implementation of apparatus according to one or more aspects of the present disclosure.

FIG. 8 is a schematic view of at least a portion of an example implementation of such a controller 400 according to one or more aspects of the present disclosure. The controller 400 may be in communication with the wellsite structure 112, the downhole tools 242, 244, 246, the fluid valves 168, 178, 184, 188, 218, 224, 226, 194, 195, 196, 199, the choke manifold 170, the pumps 144, 208, the flow rate sensors 148, 169, 182, 197, 214, the fluid level sensors 135, 152, 198, 216, the pressure sensors 156, 176, 220, and/or actuators associated with one or more of these components. For clarity, these and other components in communication with the controller 400 will be collectively referred to hereinafter as "sensor and controlled equipment." The controller 400 may be operable to receive coded instructions 442 from the human operators 234 and signals generated by the sensor equipment, process the coded instructions 442 and the signals, and communicate control signals to the controlled equipment to execute the coded instructions 442 to implement at least a portion of one or more example methods and/or operations described herein, and/or to implement at least a portion of one or more of the example systems described herein. The controller 400 may be or form a portion of one or more of the controllers 232, 266.

The controller 400 may be or comprise, for example, one or more processors, special-purpose computing devices, servers, personal computers (e.g., desktop, laptop, and/or tablet computers) personal digital assistant (PDA) devices, smartphones, internet appliances, and/or other types of computing devices. The controller 400 may comprise a processor 412, such as a general-purpose programmable processor. The processor 412 may comprise a local memory 414, and may execute coded instructions 442 present in the local memory 414 and/or another memory device. The processor 412 may execute, among other things, the machine-readable coded instructions 442 and/or other instructions and/or programs to implement the example methods and/or operations described herein. The programs stored in the local memory 414 may include program instructions or computer program code that, when executed by an associated processor, facilitate the wellsite systems 100, 300 to perform the example methods and/or operations described herein. The processor 412 may be, comprise, or be implemented by one or more processors of various types suitable to the local application environment, and may include one or more of general-purpose computers, special-purpose computers, microprocessors, digital signal processors (DSPs), field-programmable gate arrays (FPGAs), application-specific integrated circuits (ASICs), and processors based on a multi-core processor architecture, as non-limiting examples. Of course, other processors from other families are also appropriate.

The processor 412 may be in communication with a main memory 417, such as may include a volatile memory 418 and a non-volatile memory 420, perhaps via a bus 422 and/or other communication means. The volatile memory 418 may be, comprise, or be implemented by random access memory (RAM), static random access memory (SRAM), synchronous dynamic random access memory (SDRAM), dynamic random access memory (DRAM), RAMBUS dynamic random access memory (RDRAM), and/or other types of random access memory devices. The non-volatile memory 420 may be, comprise, or be implemented by read-only memory, flash memory, and/or other types of memory devices. One or more memory controllers (not shown) may control access to the volatile memory 418 and/or non-volatile memory 420.

The controller 400 may also comprise an interface circuit 424. The interface circuit 424 may be, comprise, or be implemented by various types of standard interfaces, such as an Ethernet interface, a universal serial bus (USB), a third generation input/output (3GIO) interface, a wireless interface, a cellular interface, and/or a satellite interface, among others. The interface circuit 424 may also comprise a graphics driver card. The interface circuit 424 may also comprise a communication device, such as a modem or network interface card to facilitate exchange of data with external computing devices via a network (e.g., Ethernet connection, digital subscriber line (DSL), telephone line, coaxial cable, cellular telephone system, satellite, etc.). One or more of the controlled equipment may be connected with the controller 400 via the interface circuit 424, such as may facilitate communication between the controlled equipment and the controller 400.

One or more input devices 426 may also be connected to the interface circuit 424. The input devices 426 may permit the human operators 234 to enter the coded instructions 442, such as control commands, processing routines, and input data. The input data may include Equations (1)-(12), drill string parameters (e.g., drill string dimensions, estimated contact area, tension and right-hand torque applied), wellbore and formation parameters (e.g., hydrostatic pressure, formation pressure), drilling and displacement fluid parameters (e.g., specific gravity, density, height of drilling fluid column), operational set-points, and/or other data for use by the processor 412. The operational set-points may include, as non-limiting examples, the target height of the drilling fluid 140, the target volume of the drilling fluid 140 to be evacuated from the wellbore 102, and the target volume of the displacement fluid 206 to be injected into the annulus 108. The input devices 426 may be, comprise, or be implemented by a keyboard, a mouse, a touchscreen, a track-pad, a trackball, an isopoint, and/or a voice recognition system, among other examples.

One or more output devices 428 may also be connected to the interface circuit 424. The output devices 428 may be, comprise, or be implemented by display devices (e.g., a liquid crystal display (LCD), a light-emitting diode (LED) display, or cathode ray tube (CRT) display), printers, and/or speakers, among other examples. The controller 400 may also communicate with one or more mass storage devices 440 and/or a removable storage medium 444, such as may be or include floppy disk drives, hard drive disks, compact disk (CD) drives, digital versatile disk (DVD) drives, and/or USB and/or other flash drives, among other examples.

The coded instructions 442 may be stored in the mass storage device 440, the main memory 417, the local memory 414, and/or the removable storage medium 444. Thus, the controller 400 may be implemented in accordance with hardware (perhaps implemented in one or more chips including an integrated circuit, such as an ASIC), or may be implemented as software or firmware for execution by the processor 412. In the case of firmware or software, the implementation may be provided as a computer program product including a non-transitory, computer-readable medium or storage structure embodying computer program code (i.e., software or firmware) thereon for execution by the processor 412. The coded instructions 442 may include program instructions or computer program code that, when executed by the processor 412, may cause the wellsite systems 100, 300 to perform intended methods, processes, and/or operations disclosed herein.

In view of the entirety of the present disclosure, including the figures and the claims, a person having ordinary skill in the art will readily recognize that the present disclosure introduces an apparatus comprising: a fluid source operable for injecting a displacement fluid into an annulus defined between a sidewall of a wellbore and an exterior of a drill string differentially stuck in the wellbore, thereby displacing drilling fluid in the wellbore through an internal passage of the drill string to a wellsite surface from which the wellbore extends; a fluid measuring device operable for measuring volume of the drilling fluid displaced through the internal passage; and a bleed valve operable for bleeding the injected displacement fluid out of the annulus, thereby decreasing pressure of the injected displacement fluid within the annulus.

The fluid measuring device may be fluidly connected with the internal passage proximate the wellsite surface.

The bleed valve may be fluidly connected with the annulus proximate the wellsite surface.

The displacement fluid may be or comprise a gas. For example, the gas may comprise nitrogen. The fluid source may comprise an air compressor, and the gas may be air.

The drilling fluid may have a first specific gravity, the displacement fluid may be a liquid having a second specific gravity, and the second specific gravity may be lower than the first specific gravity.

The fluid measuring device may comprise a flow meter operable for measuring the displaced drilling fluid volume. The flow meter may measure flow rate of the drilling fluid displaced through the internal passage to the wellsite surface.

The fluid measuring device may comprise: a fluid container disposed at the wellsite surface; and a fluid level sensor operable for measuring a fluid level of the drilling fluid displaced through the internal passage into the fluid container.

The bleed valve may be operable to bleed the injected displacement fluid into ambient atmosphere above the wellsite surface.

The bleed valve may be operable to bleed the injected displacement fluid out of the annulus until the displacement fluid remaining within the annulus reduces to atmospheric pressure.

The bleed valve may be operable to bleed the injected displacement fluid out of the annulus until an annulus fluid height of the drilling fluid remaining within the annulus equalizes with an internal passage fluid height of the drilling fluid remaining within the internal passage.

The apparatus may comprise a choke valve fluidly connected with the internal passage and operable for controlling flow rate of the drilling fluid being displaced from the annulus to the wellsite surface via the internal passage.

The apparatus may comprise an exhaust valve operable for fluidly connecting the internal passage with ambient atmosphere above the wellsite surface.

The apparatus may comprise a processing device comprising a processor and a memory storing computer program code, and the processing device may be operable for: receiving input data relating to at least one of the displacement fluid, the wellbore, the drill string, the drilling fluid, and a subterranean formation penetrated by the wellbore; and determining, based on the input data, a target volume of the drilling fluid to be displaced out of the wellbore to unstick the drill string. In such implementations, among others within the scope of the present disclosure, the fluid measuring device may be operable for generating a signal indicative of an actual volume of the drilling fluid displaced out of the wellbore, and the processing device may be operable for: determining, based on information conveyed in the signal, the actual volume of the drilling fluid displaced out of the wellbore; and causing the fluid source to stop injecting the displacement fluid when the actual volume reaches the target volume.

The present disclosure also introduces a method comprising: displacing drilling fluid out of a wellbore by injecting a displacement fluid into an annulus defined between a sidewall of the wellbore and an exterior of a drill string stuck in the wellbore; decreasing pressure of the injected displacement fluid within the annulus by bleeding the injected displacement fluid out of the annulus; and then moving the drill string axially within the wellbore by applying tension to the drill string.

Applying tension to the drill string may be via operation of equipment disposed at a wellsite surface from which the wellbore extends.

The drilling fluid may be displaced out of the wellbore through an internal passage of the drill string and to a wellsite surface from which the wellbore extends.

Decreasing the injected displacement fluid pressure may decrease hydrostatic pressure in the annulus. The decreased hydrostatic pressure within the annulus may reduce a differential pressure sticking the drill string against the sidewall.

The displacement fluid may be or comprise a gas. The gas may be or comprise nitrogen and/or air.

The drilling fluid may have a first specific gravity, the displacement fluid may be a liquid having a second specific gravity, and the second specific gravity may be lower than the first specific gravity.

The method may comprise determining volume of the displacement fluid injected into the annulus. Determining the injected displacement fluid volume may comprise determining the injected displacement fluid volume in real-time during the injection. Determining the injected displacement fluid volume in real-time during the injection may comprise determining the injected displacement fluid volume substantially continuously during the injection. Determining the injected displacement fluid volume in real-time during the injection may comprise determining the injected displacement fluid volume at predetermined intervals during the injection. Determining the injected displacement fluid volume may comprise measuring the injected displacement fluid volume.

The method may comprise determining volume of the drilling fluid displaced out of the wellbore. Displacing the drilling fluid out of the wellbore may comprise directing the displaced drilling fluid into a container disposed at a wellsite surface from which the wellbore extends, and determining the volume of the displaced drilling fluid may comprise measuring a fluid level of the drilling fluid directed into the container.

Bleeding the injected displacement fluid may comprise bleeding the injected displacement fluid into ambient atmosphere above a wellsite surface from which the wellbore extends.

Bleeding the injected displacement fluid may comprise bleeding the injected displacement fluid until the displacement fluid within the annulus reaches atmospheric pressure.

The drilling fluid may be displaced out of the wellbore through an internal passage of the drill string and to a wellsite surface from which the wellbore extends, and bleeding the injected displacement fluid may comprise bleeding the injected displacement fluid until an annulus fluid height of the drilling fluid remaining within the annulus equalizes with an internal passage fluid height of the drilling fluid remaining within the internal passage.

The drilling fluid may be displaced out of the wellbore through an internal passage of the drill string and to a wellsite surface from which the wellbore extends, and the method may comprise controlling flow rate of the drilling fluid being displaced out of the wellbore by controlling a choke valve fluidly connected with the internal passage.

The drilling fluid may be displaced out of the wellbore through an internal passage of the drill string and to a wellsite surface from which the wellbore extends, and the method may comprise, after displacing the drilling fluid out of the wellbore, maintaining an uphole end of the internal passage at atmospheric pressure via operation of an exhaust valve selectively operable to fluidly connect the internal passage with ambient atmosphere above the wellsite surface.

The method may comprise commencing operation of a processing device comprising a processor and a memory storing computer program code, and the processing device may be operable to determine a target volume of the drilling fluid to be displaced out of the wellbore. The method may comprise inputting, via an input device of a processing system comprising the processing device, data relating to at least one of the drilling fluid, the wellbore, the drill string, the displacement fluid, and a subterranean formation penetrated by the wellbore, and the processing device may be operable to determine the target volume based on the input data. The method may comprise commencing operation of a sensor operable to generate a signal indicative of an actual volume of the drilling fluid displaced out of the wellbore, and the processing device may be operable to determine, based on information conveyed in the signal, the actual volume of the drilling fluid displaced out of the wellbore. The processing device may be operable to halt the injection when the actual volume reaches the target volume.

The present disclosure also introduces a method comprising reducing differential pressure sticking of a drill string stuck against a sidewall of a wellbore by decreasing hydrostatic pressure around the drill string within the wellbore by:

displacing drilling fluid out of the wellbore by injecting a displacement fluid into an annulus defined between the sidewall and an exterior of the drill string; and decreasing pressure of the injected displacement fluid within the annulus by bleeding the injected displacement fluid out of the annulus.

The drilling fluid may be displaced out of the wellbore through an internal passage of the drill string and to a wellsite surface from which the wellbore extends.

The method may comprise, while decreasing hydrostatic pressure around the drill string within the wellbore, applying tension and/or torque to the drill string to free the drill string from the sidewall of the wellbore. Applying tension and/or torque to the drill string may be via operation of equipment disposed at a wellsite surface from which the wellbore extends.

The drilling fluid may be displaced out of the wellbore through an internal passage of the drill string and to a wellsite surface from which the wellbore extends.

The displacement fluid may be or comprise a gas. The gas may be or comprise nitrogen and/or air.

The drilling fluid may have a first specific gravity, the displacement fluid may be a liquid having a second specific gravity, and the second specific gravity may be lower than the first specific gravity.

The method may comprise determining volume of the displacement fluid injected into the annulus. Determining the injected displacement fluid volume may comprise determining the injected displacement fluid volume in real-time during the injection. Determining the injected displacement fluid volume in real-time during the injection may comprise determining the injected displacement fluid volume substantially continuously during the injection. Determining the injected displacement fluid volume in real-time during the injection may comprise determining the injected displacement fluid volume at predetermined intervals during the injection. Determining the injected displacement fluid volume may comprise measuring the injected displacement fluid volume.

The method may comprise determining volume of the drilling fluid displaced out of the wellbore. Displacing the drilling fluid out of the wellbore may comprise directing the displaced drilling fluid into a container disposed at a wellsite surface from which the wellbore extends, and determining the volume of the displaced drilling fluid may comprise measuring a fluid level of the drilling fluid directed into the container.

Bleeding the injected displacement fluid may comprise bleeding the injected displacement fluid into ambient atmosphere above a wellsite surface from which the wellbore extends.

Bleeding the injected displacement fluid may comprise bleeding the injected displacement fluid until the displacement fluid within the annulus reaches atmospheric pressure.

The drilling fluid may be displaced out of the wellbore through an internal passage of the drill string and to a wellsite surface from which the wellbore extends, and bleeding the injected displacement fluid may comprise bleeding the injected displacement fluid until an annulus fluid height of the drilling fluid remaining within the annulus equalizes with an internal passage fluid height of the drilling fluid remaining within the internal passage.

The drilling fluid may be displaced out of the wellbore through an internal passage of the drill string and to a wellsite surface from which the wellbore extends, and the method may comprise controlling flow rate of the drilling fluid being displaced out of the wellbore by controlling a choke valve fluidly connected with the internal passage proximate the wellsite surface.

The drilling fluid may be displaced out of the wellbore through an internal passage of the drill string and to a wellsite surface from which the wellbore extends, and the method may comprise, after displacing the drilling fluid out of the wellbore, maintaining an uphole end of the internal passage at atmospheric pressure via operation of an exhaust valve selectively operable to fluidly connect the internal passage with ambient atmosphere above the wellsite surface.

The method may comprise commencing operation of a processing device comprising a processor and a memory storing computer program code, and the processing device may be operable to determine a target volume of the drilling fluid to be displaced out of the wellbore. The method may comprise inputting, via an input device of a processing system comprising the processing device, data relating to at least one of the drilling fluid, the wellbore, the drill string, the displacement fluid, and a subterranean formation penetrated by the wellbore, and the processing device may be operable to determine the target volume based on the input data. The method may comprise commencing operation of a sensor operable to generate a signal indicative of an actual volume of the drilling fluid displaced out of the wellbore, and the processing device may be operable to determine, based on information conveyed in the signal, the actual volume of the drilling fluid displaced out of the wellbore. The processing device may be operable to halt the injection when the actual volume reaches the target volume.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the spirit and scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. A method comprising:

displacing drilling fluid out of a wellbore by injecting a displacement fluid into an annulus defined between a sidewall of the wellbore and an exterior of a drill string stuck in the wellbore;

decreasing pressure of the injected displacement fluid within the annulus by bleeding the injected displacement fluid out of the annulus; and moving the drill string axially within the wellbore by applying tension to the drill string, wherein bleeding the injected displacement fluid comprises bleeding the injected displacement fluid until the displacement fluid within the annulus reaches atmospheric pressure.

2. A method comprising:

displacing drilling fluid out of a wellbore by injecting a displacement fluid into an annulus defined between a sidewall of the wellbore and an exterior of a drill string stuck in the wellbore;

decreasing pressure of the injected displacement fluid within the annulus by bleeding the injected displacement fluid out of the annulus; and moving the drill string axially within the wellbore by applying tension to the drill string, wherein the drilling fluid is displaced out of the wellbore through an internal passage of the drill string and to a wellsite surface from which the wellbore extends, and wherein bleeding the injected displacement fluid comprises bleeding the injected displacement fluid until an annulus fluid height of the drilling fluid remaining within the annulus equalizes with an internal passage fluid height of the drilling fluid remaining within the internal passage.

3. A method comprising:

reducing differential pressure sticking of a drill string stuck against a sidewall of a wellbore by decreasing hydrostatic pressure around the drill string within the wellbore by:

displacing drilling fluid out of the wellbore by injecting a displacement fluid into an annulus defined between the sidewall and an exterior of the drill string; and decreasing pressure of the injected displacement fluid within the annulus by bleeding the injected displacement fluid out of the annulus, wherein bleeding the injected displacement fluid comprises bleeding the injected displacement fluid until the displacement fluid within the annulus reaches atmospheric pressure.

4. A method comprising:

reducing differential pressure sticking of a drill string stuck against a sidewall of a wellbore by decreasing hydrostatic pressure around the drill string within the wellbore by:

displacing drilling fluid out of the wellbore by injecting a displacement fluid into an annulus defined between the sidewall and an exterior of the drill string; and decreasing pressure of the injected displacement fluid within the annulus by bleeding the injected displacement fluid out of the annulus, wherein the drilling fluid is displaced out of the wellbore through an internal passage of the drill string and to a wellsite surface from which the wellbore extends, and wherein bleeding the injected displacement fluid comprises bleeding the injected displacement fluid until an annulus fluid height of the drilling fluid remaining within the annulus equalizes with an internal passage fluid height of the drilling fluid remaining within the internal passage.

* * * * *